US005811715A

United States Patent [19]

Åsbrink

[11] Patent Number: 5,811,715

[45] Date of Patent: Sep. 22, 1998

[54] PRACTICE WEAPON FOR A CARRIED RECOILLESS ANTI-TANK WEAPON

[75] Inventor: Mats Åsbrink, Stockholm, Sweden

[73] Assignee: Simbal AB, Karlskoga, Sweden

[21] Appl. No.: 669,491

[22] PCT Filed: Dec. 27, 1994

[86] PCT No.: PCT/SE94/01256

§ 371 Date: Jul. 11, 1996

§ 102(e) Date: Jul. 11, 1996

[87] PCT Pub. No.: WO95/18948

PCT Pub. Date: Jul. 13, 1995

[30] Foreign Application Priority Data

Jan. 11, 1994 [SE] Sweden ..... 9400043

[51] Int. Cl.[6] ..... F41B 21/10

[52] U.S. Cl. ..... 89/29; 89/1.705

[58] Field of Search ..... 89/29, 1.704, 1.705, 89/1.706

[56] References Cited

U.S. PATENT DOCUMENTS

| | | | |
|---|---|---|---|
| 2,970,519 | 2/1961 | Musser et al. | 89/1.704 |
| 3,144,808 | 8/1964 | Stapp et al. | 89/1.704 |
| 3,489,058 | 1/1970 | Wallberg et al. | 89/1.705 |
| 3,618,250 | 11/1971 | Grandy | 42/77 |
| 4,676,136 | 6/1987 | Kalin | 89/1.704 |

FOREIGN PATENT DOCUMENTS

| | | |
|---|---|---|
| 20 59 202 | 1/1975 | Germany . |
| 936502 | 9/1963 | United Kingdom . |

*Primary Examiner*—Stephen M. Johnson
*Attorney, Agent, or Firm*—Jacobson, Price, Holman & Stern, PLLC

[57] ABSTRACT

A practice weapon for a hand-held recoilless anti-armor weapon including a sub-calibre barrel mounted in a full caliber barrel to enable a marksman to repeatedly train and be subjected to the powerful noise and pressure effects of firing a full caliber weapon. The practice weapon according to the invention includes a marker charge, which is arranged to be ignited in response to firing of a sub-caliber practice round. In order to transfer the ignition sequence in a simple fashion with few moving parts, the marker charge is arranged to be ignited by the jet of flame and powder gases generated by the firing of the practice round.

6 Claims, 3 Drawing Sheets

PRACTICE WEAPON FOR A CARRIED RECOILLESS ANTI-TANK WEAPON

FIELD OF THE INVENTION

The present invention relates to a practice weapon for a hand-held recoilless anti-armour weapon. Such weapons take the form either of expendable one-shot anti-armour weapons or of assault rifles, and they are in use in many countries, including Sweden. The expendable one-shot anti-armour weapon and the assault rifle are equivalent types of weapon from the point of view of their field of use and effect but the assault rifle is reloadable. In Sweden they are represented by the 84 mm light anti-armour weapon AT4 (in Sweden called pansarskott 86) and the RCL Carl-Gustav M2 (in Sweden called the m/48 Carl-Gustav) respectively.

BACKGROUND OF THE INVENTION

When practice firing these weapons the infantryman cannot fire many full-calibre rounds, if any at all, since inert full-calibre rounds, i.e., rounds without a high explosive (HE) charge, are virtually as expensive as rounds with a high explosive charge. Until now, therefore, practice weapons with a sub-calibre barrel mounted within the weapon have been used. In the case of the expendable recoilless anti-armour weapon a special practice weapon with a permanently assembled sub-calibre barrel for 9 mm ammunition has been used. For the assault rifle the sub-calibre barrel, for 20 mm ammunition, is mounted in a special fixture resembling the live round which is loaded into the weapon in the same fashion as an HE round is loaded.

The marksman fires a sub-calibre round instead of an expensive round and this is entirely satisfactory for studying the marksman's success in hitting the target. He normally rapidly learns to fire accurately. It has, however, proved to be the case that marksmen who have the opportunity of firing full calibre rounds after successful training do not succeed as well as is desirable.

The reason for this is that the marksman who has been trained to aim and fire with his accustomed practice weapon tenses himself and is affected by the powerful disturbance he is subjected to when firing the full calibre round despite the fact that it is a recoilless weapon. The marksman experiences severe noise and pressure effects.

Clearly it is necessary for the marksman to have the opportunity of repeated practice to be subjected to these effects.

Weapons with marker charges are previously known from the German patent 2 059 202, the British patent 936 502 and the American patent 3,489,058. None of these shows, however, a practice weapon which in a simple way can be used both for initial firing practice without marker charge and final practice with such a charge.

SUMMARY OF THE INVENTION

The present invention solves this problem to a fraction of the cost of firing full calibre rounds by being designed as is evident from the following main claim.

BRIEF DESCRIPTION OF THE DRAWINGS

In the following the invention will be described in greater detail with reference to the appended drawings, in which.

DETAILED DESCRIPTION OF THE PREFERRED EMBODIMENTS

Figure 1:
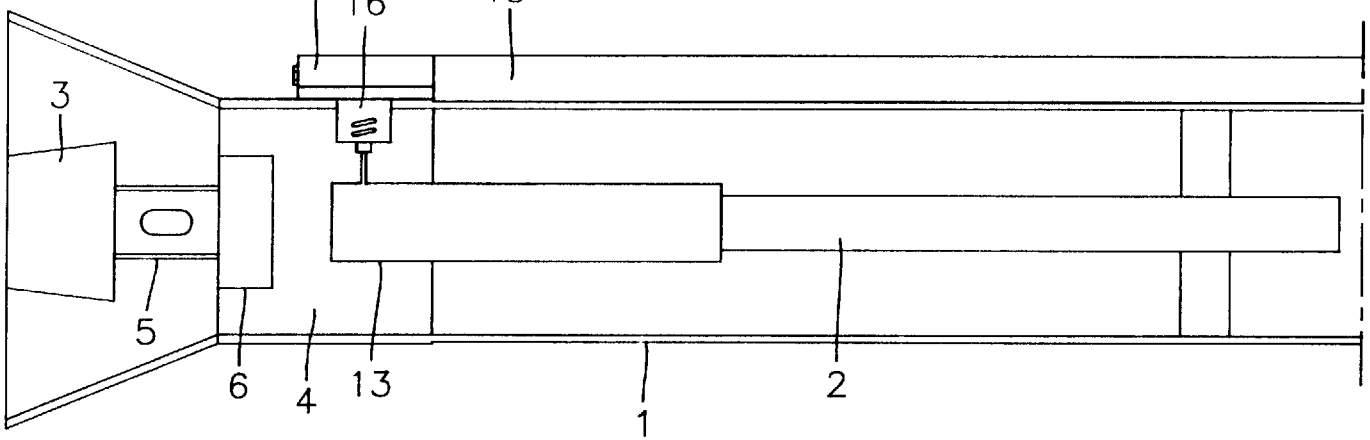
FIG. 1 shows in principle, mostly in longitudinal cross section, the design of a recoilless anti-armour weapon equipped with a practice fixture according to the invention.

In the present invention a sub-calibre cartridge or round 20 including barrel 2 for a sub-calibre projectile, and a marker charge 3 dimensioned to subject the marksman to a realistic effect of firing a full calibre round, is mounted in the barrel 1 of the recoilless anti-armour weapon or the assault rifle.

The marker charge 3 is located behind the barrel sub-calibre, as viewed from the direction of fire, and is arranged to be ignited by the jet of flame from the charge of the practice round 20. To achieve satisfactory function 4 is very important that the jet of flame from the practice round 20 be used in this fashion to ignite the marker charge 3. Conceivable alternative designs using some form of mechanical transmission of the ignition sequence from one charge to another would be considerably more complicated, have more moving parts and be more expensive.

By the use of the jet of flame from the charge of the sub-calibre round 20 to ignite the marker charge the sequence will also be slightly delayed. This is very suitable and desirable, since the duration of the pressure effects of a full calibre round, which is what it is desired to simulate, is comparatively long, of the order of magnitude of 20 ms.

In tests on a practice weapon according to the invention a duration of 7 ms was achieved, which is of an acceptable magnitude. It is not an absolute requirement that the time sequence be as long as for a full calibre round for the marksman to become well accustomed to the noise and pressure effects.

The barrel 2 and marker charge 3 can be mounted in a similar fashion as is used in well known sub-calibre barrels for training purposes, i.e., in the case of the recoilless anti-armour weapon directly in the barrel and in the case of the assault rifle in a special fixture resembling an HE round which is loaded into the weapon like an HE shell.

In practice it is suitable to attach the sub-calibre barrel 2 to a cross wall in the barrel 1 such that the cross wall also functions as a breech block 4 for the sub-calibre barrel 2 and round 20. The marker charge 3 is attached to the other side of the breech block 4. This is arranged in one suitable design of the invention by screwing the marker charge 3 via a distance piece 5 firmly into a threaded hole 6 in the breech block.

Naturally the opposite procedure is possible, i.e., the distance piece may be screwed onto a threaded tap on the breech block 4.

It is important that the distance piece 5 be screwed firmly in place, so as to prevent the distance piece 5 coming loose and being thrown out of the rear of the weapon and injuring persons beyond the normal risk area of the practice weapon. To ensure this the practice weapon may suitably be equipped with a safety mechanism which senses that the distance piece is screwed sufficiently firmly to the breech block 4.

One suitable design for such a safety mechanism is to drill a hole in the breech block 4 at or near the bottom of the threaded hole 6 for the distance piece 5 allowing a pin to run in the hole in such a fashion that the pin is forced down against a spring loading beneath the distance piece when the latter is screwed in. The pin then frees the firing mechanism.

In the practical tests carried out for a new practice weapon for the anti-armour weapon AT4 a 20 mm barrel and ammunition, 20 mm tracer practice round m/64, for the training system for the m/48 has been used with a specially fabricated breech block and a specially fabricated marker charge. The marker charge contained 110 g barium nitrate.

Figure 3:
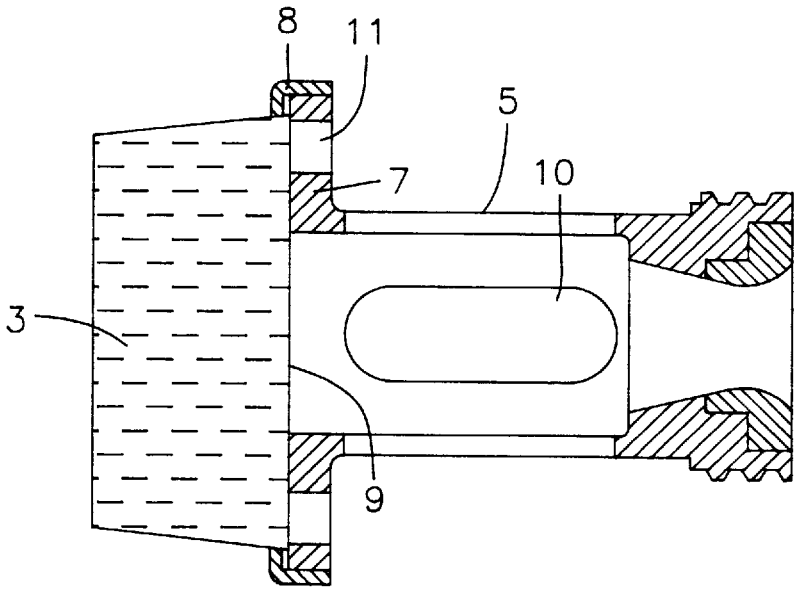
FIG. 3 shows a section through a marker charge with distance piece according to one embodiment of the invention.
Figure 4:
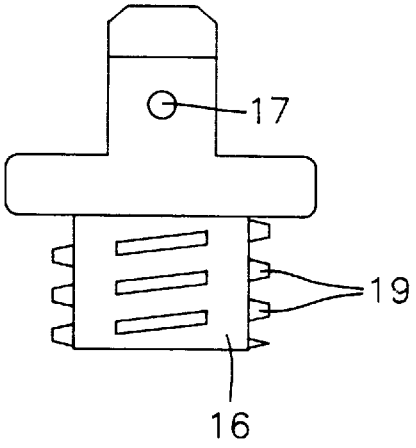
FIG. 4 shows one embodiment of the part of the invention called the striker housing as seen from the front.

The distance piece 5, see FIG. 3, is shaped as a tube and the jet of flame from the charge of the sub-calibre round 20 can travel along its bore from the sub-calibre round 20. In the end of the distance piece 5 that is remote from the end of the distance piece 5 on which the marker charge 3 is mounted. The marker charge 3 is attached to a flange 7 on the end of the distance piece 5 that is remote from the practice round 20. The marker charge 3 may be affixed to the flange by some simple means, for example with a bayonet fixing 8.

The marker charge 3 may at the end of the tube be covered by a membrane 9 of paper or other inflammable material or may be covered by some material which is pulverized when the marker charge detonates, so that no one behind the weapon is injured. The marker charge can be covered at other points by a material with similar properties.

The distance pied 5 is provided with extensive holes 10 in order to lead the powder gases through passage 24 from the sub-calibre round past the marker charge 3 and out of the weapon.

The flange 7 can also be provided with holes 11 around its circumference to reduce the surface upon which the powder gases from the marker charge can react to generate a recoil. If this were not done the marker charge could generate a forwardly directed recoil. These holes must be calculated from case to case according to principles well known to the man skilled in the art and based upon powder charge weight, weapon and charge geometry and other relevant factors.

Figure 2:
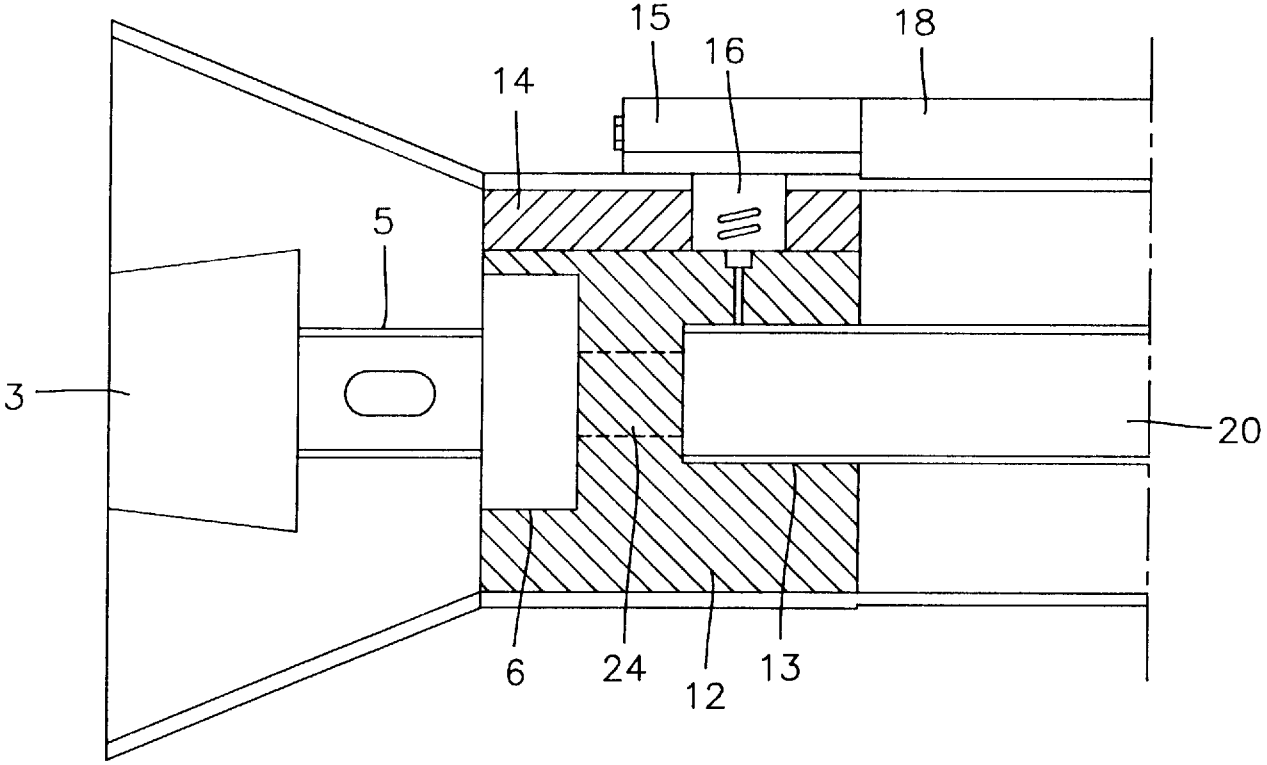
FIG. 2 shows on an enlarged scale a part of FIG. 1 with special attention to the breech block and a part of the firing mechanism.

The breech block, see FIG. 2, consists of a main part 12, with a threaded hole 13 for the barrel 2 and a bore or passage 24 between hole 13 and threaded hole 6 for the distance piece 5 of the marker charge 3, and a component 14 to secure the striker housing 15 to the main part. The main part 12 has a hole drilled into it, in which the first pin runs, which participates in causing the firing mechanism to be released., In one suitable design of the invention the hole runs primarily in the longitudinal direction of the weapon.

The release of the firing mechanism is brought about by the fact that the first pin, after it has been pushed back by the distance piece 5, no longer prevents a crossing second pin from being driven down through its hole. This is because the first pin has a notch, which is aligned with the hole for the second pin, when the first pin is depressed.

When the second pin is able to be moved down through its hole, one end of the pin no longer prevents the striker housing 15 from turning away from a first position, where the weapon is not loaded, to a second position, where it is loaded.

Furthermore the second pin may suitably be utilized to retain the striker housing in the loaded position by virtue of the fact that this pin too is moved out of engagement against a spring loading, so that, after the striker housing 15 has turned to the loaded position, the pin is forced by its spring loading to engage a locking hole in the bottom of the striker housing.

The striker housing 15 has, in one proposed design of the invention, a partially threaded cylindrical tap 16, in which the striker pin runs. At a large angle to the striker pin, approximately at right angles, an actuating pin 17 runs, which in its turn can be affected by the trigger mechanism 18. In the same fashion as is the case with the corresponding weapons for firing full calibre rounds, a horizontal displacement of the actuating pin 17 is translated into a vertical displacement of the striker pin causing it to contact a percussion cap, which in turn ignites the sub-calibre round 20. In an established fashion the actuating pin and the striker pin may be chamfered 45° where they contact one another.

The tap 16 of striker housing 15 has threads 19 around parts of its circumference and at other parts of its circumference it is without such threads, which constitutes a type of bayonet fixing. The component 14 has a mating hole.

When loading, the striker housing 15 is turned to the first position, where it can be lifted out of the component 14. Thereafter the round 20 is pushed into the cartridge seat, whereupon the distance piece 5 with the marker charge 3 is screwed into position. Then, with the striker housing removed, a percussion cap is placed in the recess in the main part 12 of the breech block 4 intended for this purpose, the recess being then exposed. Thereafter the striker housing 15 is once again put down into the component 14 and turned to the second position, where it is firmly locked. This turn is, as mentioned above, only possible if the distance piece 5 is fully screwed in. The striker pin is now aimed at the percussion cap and the actuating pin 17 is pointing toward the trigger mechanism 18. The weapon is ready to fire.

For manufacturing reasons the breech block 4 in the example is divided into a main part 12 and a component 14, the latter being intended to secure the striker housing. The component 14 is attached to the main part in an established fashion, for example by means of screws. It is naturally possible instead to fabricate what has here been called the main part 12 and the component 14 in one piece.

Finally, for the sake of completeness, it should once again be pointed out that it is possible to use a practice weapon according to the invention without the marker charge 3. It then functions in the same fashion as established practice weapons without the sensations of a full calibre weapon.

I claim:

1. A practice weapon for a hand-held recoilless anti-armour weapon comprising a barrel of the weapon, a sub-calibre barrel for a practice round mounted in the barrel of the weapon, and a marker charge mounted in the barrel of the weapon in spaced relation to said round, said marker charge being supported in a position to be ignited from the jet flame from the practice round when fired to subject a marksman using the practice weapon to a realistic sensation of firing a full calibre weapon.

2. A practice weapon according to claim 1 including a cross wall fixed within the barrel of the weapon, said sub-calibre barrel being affixed to one side of said cross wall, said cross wall functioning as a breech block, said opposite side of said cross wall having the marker charge attached thereto by a distance piece, said cross wall including a passage communicating the sub-calibre barrel with the distance piece.

3. A practice weapon according to claim 2 wherein said distance piece is shaped as a tube and has holes along a curved structure thereof such that the jet flame can pass through the tube and powder gases from a charge in the practice round can, via the holes, be conducted past the marker charge and further out of the barrel.

4. A practice weapon according to claim 3 wherein said marker charge is attached to a flange on the distance piece.

5. A practice weapon for practice firing of a hand-held recoilless anti-armour weapon to enable a user to become accustomed to the effects of firing a full calibre weapon, said practice weapon comprising a full calibre barrel, a breech block in the form of a cross wall mounted in said full calibre barrel adjacent on end thereof, a sub-calibre barrel mounted on one side of said breech block and extending longitudinally in said full calibre barrel, said sub-calibre barrel adapted to receive and fire a sub-calibre practice round, a distance piece mounted on a side of said breech block opposite to said sub-calibre barrel and substantially in alignment with said sub-calibre barrel, and a marker charge mounted on said distance piece in said one end of the full calibre barrel, said breech block including a passage therethrough, said distance piece being tubular for enabling a jet of flame produced by the sub-calibre practice round to pass through said passage and said distance piece and ignite said marker charge to subject the user of the practice weapon to pressure effects produced when firing a full calibre round from said hand-held recoilless anti-armour weapon.

6. The practice weapon as defined in claim 5, wherein said distance piece includes longitudinal openings to enable passage of powder gases and jet flame into igniting engagement with said marker charge.

* * * * *